US005230643A

United States Patent [19]

Kanno

[11] Patent Number: 5,230,643

[45] Date of Patent: Jul. 27, 1993

[54] REMOTE SHIFTING SYSTEM FOR MARINE PROPULSION UNIT

[75] Inventor: Isao Kanno, Hamamatsu, Japan

[73] Assignee: Sanshin Kogyo Kabushiki Kaisha, Hamamatsu, Japan

[21] Appl. No.: 705,772

[22] Filed: May 28, 1991

[30] Foreign Application Priority Data

May 30, 1990 [JP] Japan ..... 2-138585

[51] Int. Cl.[5] ..... B63H 21/21

[52] U.S. Cl. ..... 440/86

[58] Field of Search ..... 440/1, 75, 86; 180/336; 364/424.1

[56] References Cited

U.S. PATENT DOCUMENTS

| | | | |
|---|---|---|---|
| 4,646,870 | 3/1987 | Koch et al. | 180/336 |
| 4,726,798 | 2/1988 | Davis | 440/75 |
| 5,080,619 | 1/1952 | Uchida et al. | 440/86 |

*Primary Examiner*—Sherman Basinger
*Attorney, Agent, or Firm*—Ernest A. Beutler

[57] ABSTRACT

A remote shifting system for a marine propulsion unit that employs only forward, neutral and reverse sensing switches for the transmission. A control routine is established whereby when a shift is initiated, the transmission is first moved to its neutral position and then moved to the desired shift position if it is other than a neutral condition. A warning circuit is incorporated for providing a warning and/or protective action in the event a shift does not occur within a predetermined normal time period.

16 Claims, 5 Drawing Sheets

REMOTE SHIFTING SYSTEM FOR MARINE PROPULSION UNIT

BACKGROUND OF THE INVENTION

This invention relates to a remote shifting system for a marine propulsion unit and more particularly to an improved and simplified electronically controlled remote shift mechanism for a marine outboard drive.

As is well known, most marine propulsion units include a forward neutral reverse transmission which permits the watercraft to be operated in either forward or reverse drive mode or in a neutral condition. Frequently, it is desirable to provide a remote actuator for actuating the transmission, which is generally positioned with the outboard drive portion of the propulsion unit and frequently in its lower unit. One type of remote control mechanism which has been employed incorporates an electric follow-up system wherein the operator controls a remote shift lever which, in turn, transmits a position signal to a remote servo motor for actuating the transmission control to the selected position. Such systems normally employ a potentiometer on the transmission shift lever and on the shift control with a comparator circuit to determine discrepancies in the two positions so as to operate a motor to bring coincidence into the two positions. Although such arrangements are satisfactory, the use of two potentiometers can give rise to expense in the control mechanism.

In order to reduce the cost of the system, it would be desirable to employ only position responsive switches at the transmission control end. However, when only position responsive switches are employed it is impossible for the system to determine when the transmission control is in an intermediate position between its forward, neutral and reverse positions.

It is, therefore, a principal object of this invention to provide an improved remote shifting system for a marine propulsion unit which permits the use of position responsive switches in the control mechanism.

It is a further object of this invention to provide a control routine for a remote shifting system for a marine propulsion unit that permits the use of only position responsive switches in the transmission control.

SUMMARY OF THE INVENTION

This invention is adapted to be embodied in a remote transmission control having at least a neutral condition when drive is not transmitted and a drive condition when drive is transmitted. Shift means are connected to the transmission and moveable between at least a neutral position corresponding to the neutral condition of the transmission and a drive position corresponding to the drive condition of the transmission. First and second position sensing means are provided for sensing only when the shift means is in the neutral and drive positions, respectively, and when the shift means is not in the respective position. Power means are provided for moving the shift means between its positions. An operator actuated shift actuator is moveable between a neutral position through a plurality of intermediate positions and a drive position. Third position sensing means are provided for sensing the actual position of the shift actuator. Control means are responsive to operation of the shift actuator to one of its neutral and drive positions for operating the power means to position the shift means in the neutral position if not in that position and then in the position corresponding to the final position of the shift actuator if other than in the neutral position.

DETAILED DESCRIPTION OF THE PREFERRED EMBODIMENT OF THE INVENTION

Figure 1:
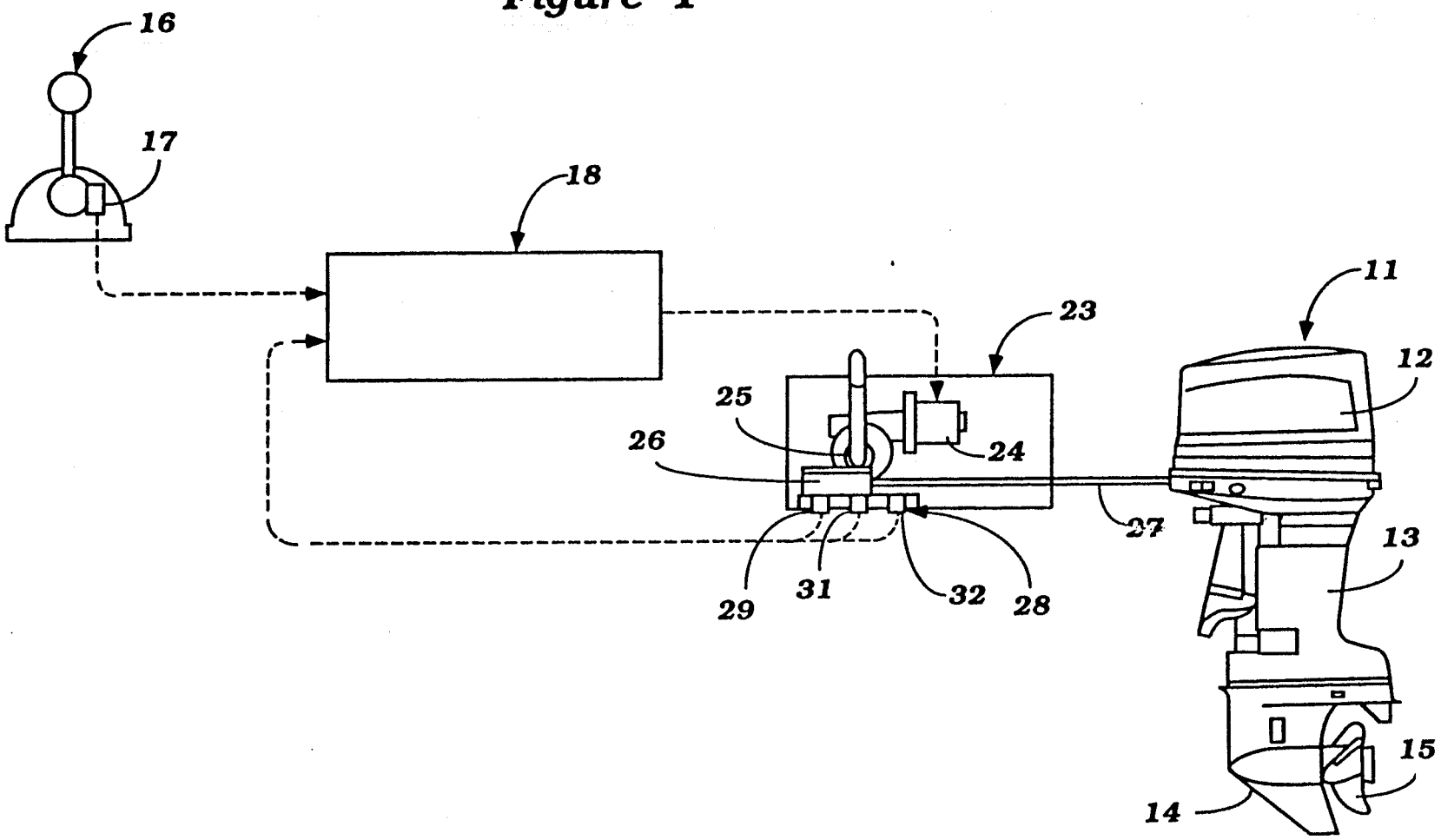
FIG. 1 is a partially schematic side elevational view of a remote control shifting mechanism, constructed in accordance with an embodiment of the invention, as applied to an outboard motor.

Referring first to FIG. 1, an outboard motor is identified generally by the reference numeral 11 and includes a power head 12 that contains a powering internal combustion engine and which drives a drive shaft (not shown) that rotates about a generally vertically extending axis and which is journaled within a drive shaft housing 13 depending from the power head 12. This drive shaft drives a forward neutral reverse transmission (not shown) contained within a lower unit 14 for driving a propulsion device such a propeller 15 and selected forward or reverse directions. This forward neutral reverse transmission may be of the conventional bevel gear type including a driving bevel gear that is drivingly engaged with a pair of counter-rotating driven bevel gears that are journaled on a shaft of the propeller 15 and coupled for rotation with it through a dog clutching system. Since such transmissions are well known in this art, detailed description of them is believed to be unnecessary.

The aforedescribed forward neutral reverse transmission is controlled by means of a remotely positioned shift actuator, indicated generally by the reference numeral 16, which is positioned at a remote location in the watercraft convenient to the operator. The shift actuator 16 is, in the illustrated embodiment, a pivotally supported lever mechanism that cooperates with a potentiometer 17 that provides an indication of the position of the shift actuator 16. As may be seen in FIG. 2, the shift actuator 16 may be moveable from a neutral position, as shown in solid line view in this Figure and indicated at N in a first or forward direction to a forward position indicated in phantom at F or in the opposite direction to a reverse position as indicated at R. The potentiometer 17 indicates the actual position of the shift lever regardless of whether it is in the forward F, neutral N or reverse positions R or in any intermediate positions.

Figure 2:
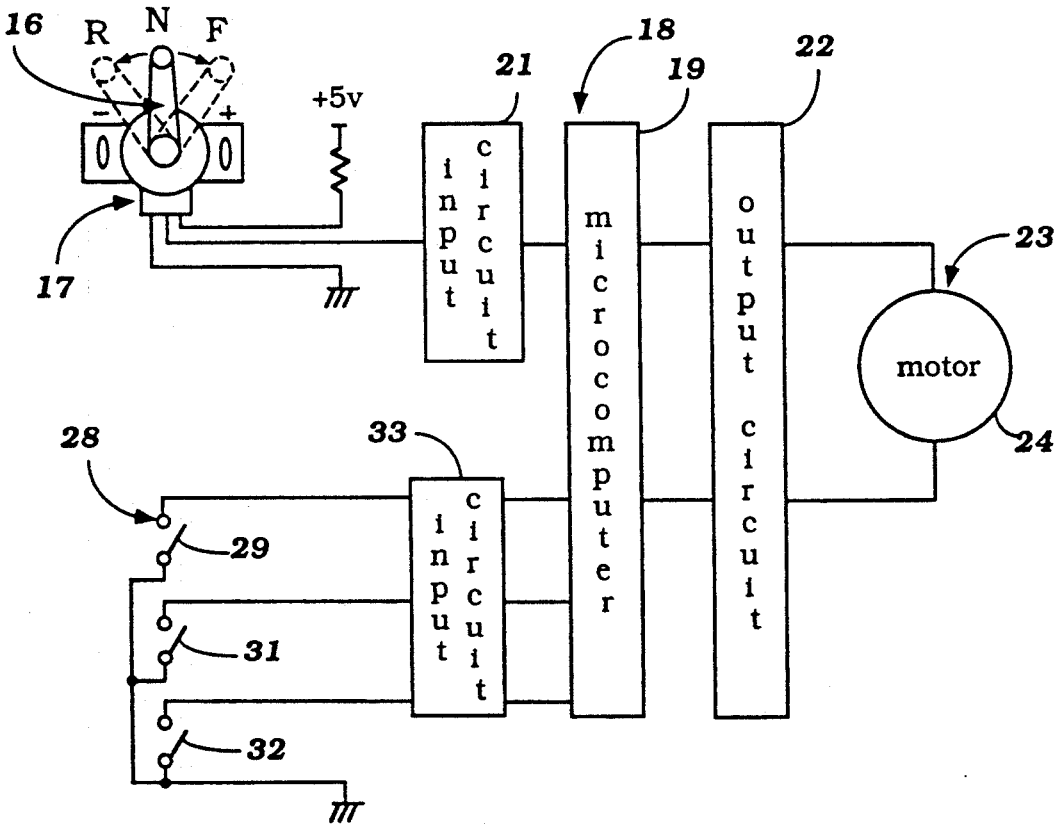
FIG. 2 is a schematic view showing the elements of the shift control mechanism.

The output of the potentiometer 17 is transmitted to a control unit, indicated generally by the reference numeral 18 and which has components shown in block form in FIG. 2. These components are a micro-computer 19 that receives an input signal from the potentiometer 17 through an input circuit 21. The micro-computer 19 is programmed to provide a control routine, as which will be described, and outputs a signal to an output circuit 22 which, in turn, drives a servo mechanism, indicated generally by the reference numeral 23 and which is comprised primarily of a reversible electric motor 24. The motor 24 drives a gear train 25 which is coupled to a shift means in the form of a reciprocating actuator 26 that is coupled by means of a wire actuator 27 to the transmission of the lower unit 14 in any of the many well known manners.

A sensing unit, indicated generally by the reference numeral 28 is provided for sensing when the shift means 26 is in its forward, neutral or reverse conditions or when it is not in these conditions. This sensing mechanism includes a forward position sensing switch 29, a neutral position sensing switch 31, and a reverse sensing switch 32. When the shift means 28 is in a position intermediate its forward, neutral, or reverse conditions, none of the switches 29, 31 and 32 will be closed. Said another way, the sensing mechanism 28 only senses when the shift means 26 is in or not in its forward, neutral or reverse position without sensing any intermediate condition. The outputs from the position sensing switches 29, 31 and 32 are transmitted to the micro-computer 19 by an input circuit 33 of the control unit 18.

As has been described, the system includes a potentiometer 17 that senses the actual position of the shift actuator 16 and three limit switches 29, 31 and 32 which only will sense when the shift means is in the forward, neutral or reverse positions, respectively. Therefore, the control unit 18 must function in such a way as to establish a control routine that will place the shift means 26 in the forward, neutral or reverse position when the shift actuator 16 is moved in its forward, neutral or reverse position. This control routine is preprogrammed into the micro-computer 19 and follows a control routine as will now be described by reference to FIGS. 3 through 5.

Figure 3:
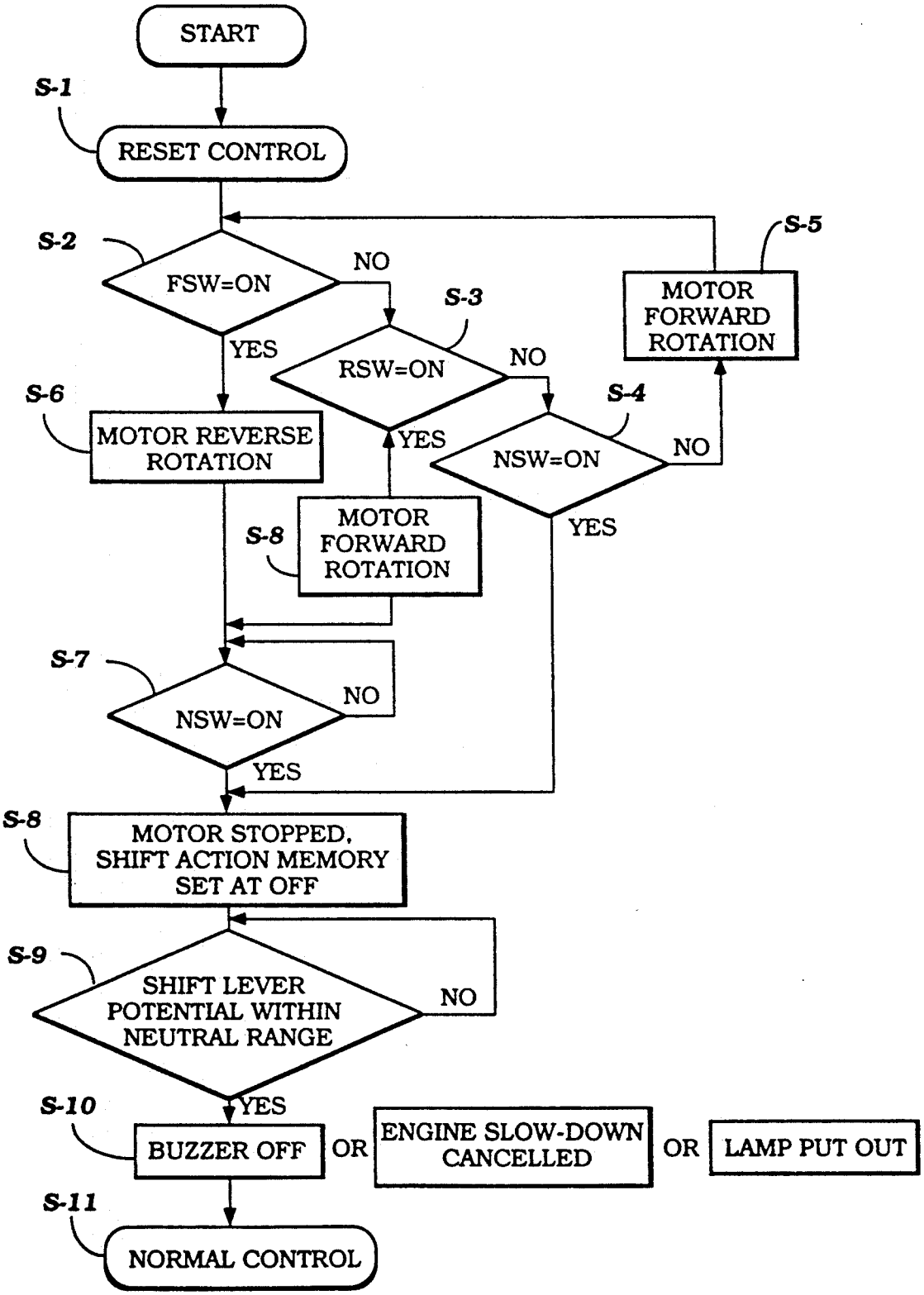
FIG. 3 is a block diagram showing the control routine during the initial start and reset operation.

This control routine first comprises a reset control routine as shown in FIG. 3 which is initiated either at the start of control or if during normal control it is determined that the present position of the shift means 28 does not correspond to the present position of the shift actuator 16.

When the program is started it initially moves to the step S1 to initialize the reset control. The program then moves to the step S2 to determine if the forward shift means switch 29 is in its on condition. If at the step S2 it is determined that the forward switch 29 is not on, the program moves to the step S3 to determine if the shift member 28 is in its reverse position as will be indicated by the condition of the reverse switch 32. In other words, at the step S3 it is determined if the switch 32 is closed. If this switch is not closed, the program then moves to the step S4 to determine if the shift means 26 is in its neutral position by determining if the switch 31 is closed.

If after it is determined that the shift means 26 is not in either of its forward, neutral or reverse conditions through closures of the switch 29, 31 and 32, the control routine begins to operate the shift means 26 to return it to its neutral condition. The program is set so as to first initiate forward rotation of the motor 24 so as to move the shift means 26 toward its forward condition. This is accomplished at the step S5.

After the forward rotation of the motor 24 is initiated, the program then returns back .to the step S2 to determine if the forward switch 29 is closed. If the shift means 26 were between the neutral and forward position when this sequence was operated, then the shift means 26 will be moved toward its forward drive condition. Therefore, if this condition did occur or if the program was initiated when the shift means 26 was in its forward position then the program will move from the step S2 to the step S6 so as to initiate reverse rotation of the motor 24 so as to return the shift means in a reverse direction.

Hence, if the shift means 29 was, at the start of operation, in the forward position then the program would immediately proceed to the step S6 to move the shift means 26 toward its neutral position. If, on the other hand, the shift means 26 was initially between the neutral and forward positions, the control routine will first move the shift means 26 to the forward position and then move to the step S6 so as to reverse the direction of movement of the shift means to move it to its neutral position. These sequences will then operate until the program moves to the step S7 to sense the condition of the neutral switch. If the neutral switch is on the program will exit the aforedescribed control routine.

If at the initiation of the reset control at the step S1, the shift means 26 and transmission were between the reverse position and the neutral position, the program will continue to move through the steps S2, S3, S4, and S5 until the neutral condition is sensed at the position S4 and the program will then move onto the control routine beyond the step S7.

If, however, at the initiation at the reset procedure, it is determined that the shift means 26 is in the reverse position as sensed by the closure of the switch 32, the control routine will move to the step S3 and when determining that the switch 32 is on will move to the step S8 so as to effect forward rotation of the motor 24 to move the shift means 26 and transmission toward its neutral position. This movement will continue until the neutral switch 31 is determined to be on at the step S4 and the program will then move to the step below the step S7. Therefore, it should be clear that the system operates upon start-up or upon reset control to move the transmission and shift means 26 to its neutral position in the described routine.

After the transmission has been moved to its neutral position by moving the shift means 26 to close the neutral switch 31, the program moves to a step S8 which stops the operation of the motor 24 and sets any shift action memory which may have been previously set on to an off condition. The setting of the switch memory condition to on will be described later in the normal control routine: The program then moves to the step S9 to determine if the position of the lever of the shift actuator 16 is in its neutral condition as sensed by the output of the potentiometer 17. If it is not, this portion of the program will continue to repeat back until it is determined that the shift lever of the shift actuator 16 is in its neutral position.

Once the shift lever 16 is in its neutral position, the program moves to the step S10 so as to shut off any protective systems which may have been initiated, as will also be described. These may constitute one or more of the warnings of a buzzer, the initiation of an engine slow-down, and/or the initiation of a warning lamp output all of which will be switched off. The program then moves to the step S11 so as to permit normal control routine.

Figure 4:
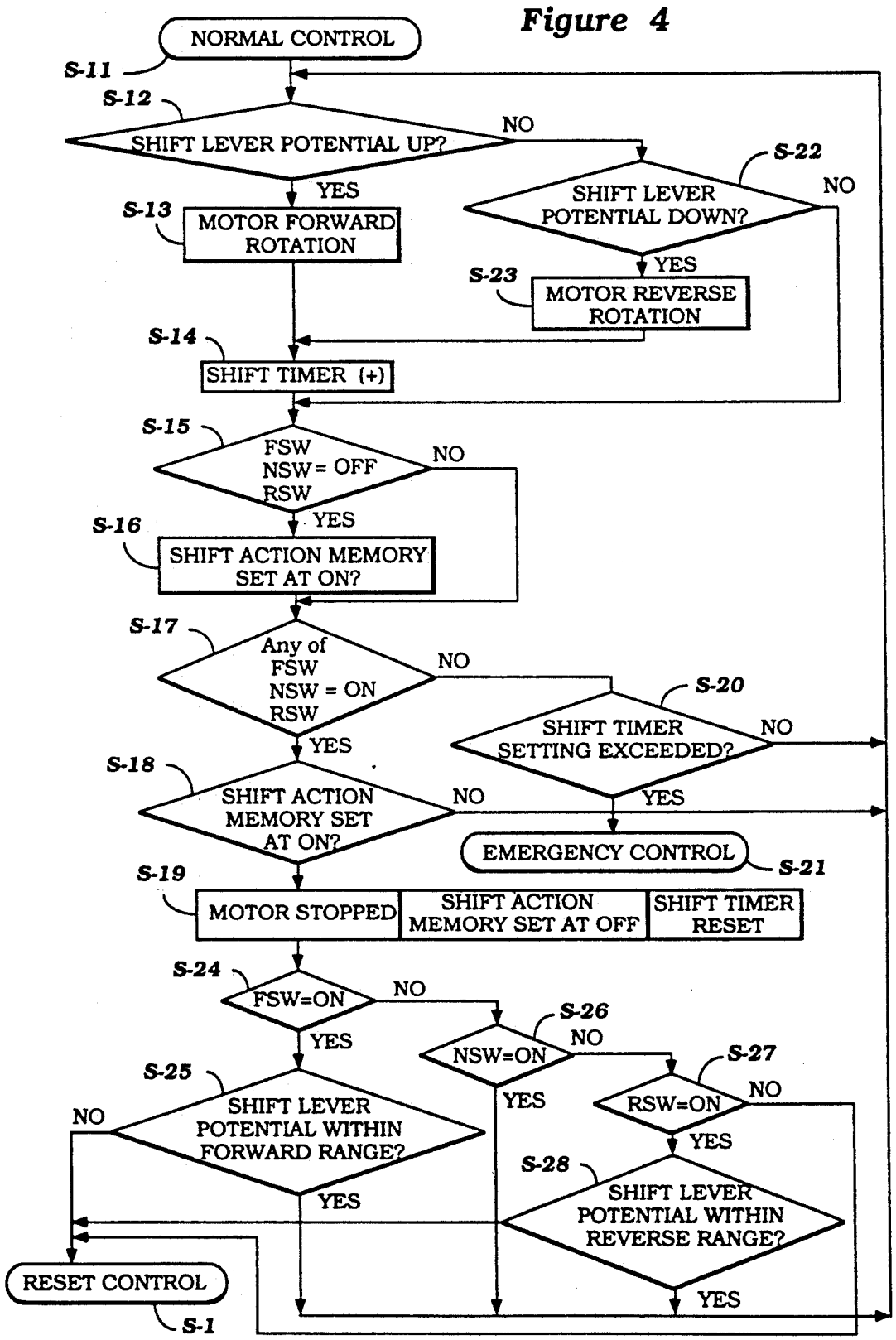
FIG. 4 is a block diagram showing the control routine during normal shifting operation.

Referring now to FIG. 4>this normal control routine will be described. From the normal start position S11, the program moves to a step S12 to determine if the potential of the shift actuator 16 has increased as sensed by the potentiometer 17. Movement of the shift lever in a forward direction will cause an increase in the output of the potentiometer 17 as sensed by the control unit 18. If this condition prevails, the program moves to the step S13 to initiate forward rotation of the motor 24. Simultaneously, at the step S14 a shift timer is set to begin running. The shift timer is set so that if the completion of the shift is not accomplished within a predetermined time period, as set by the timer in the step S14, an emergency control, as will be described will be initiated.

The program then moves to the step S15 to determine if all of the switches 29, 31 and 32 are off. If they are all off, then the program moves to the step S16 so as to set the shift action memory switch to an on condition. The program then moves to a step S17 to determine if any of the switches 29, 31 and 32 are switched on. If at the step S17 it is determined that one of the switches is on, and considering that forward shifting has been called for, the program then assumes that the transmission is in forward and moves to the step S18 to determine if the memory switch has been turned on. If it has been, then the program moves to the step S19 so as to stop the motor, set the switch action memory switch off and also to reset the timer.

If, however, at the step S17 it has been determined that none of the switches 29, 31, and 32 are on, the program moves to the step S20 to determine if the shift timer setting has been exceeded. If it has not, the program repeats until the shift to forward is completed. If, however, it is determined that the timer has been exceeded, the program moves to the step S21 so as to initiate emergency control, which will be described later by reference to FIG. 5.

The aforedescribed shifting condition has assumed that the transmission shift actuator 16 was in the neutral condition and was moved to the forward drive position. If, however, at the step S12 it is determined that the shift lever potential had not gone up, then the program moves to the step S22 to determine if the shift lever potential has moved down indicating a movement toward the reverse position by a decreased potential of the potentiometer 17. If the shift potential is determined not to have gone up or to have gone down at the steps S12 and S13 the program then moves to the step S15 since it may be assumed that the shift lever in that event has not been moved and is still in the neutral condition.

If, however, it is determined at the step S22 that the potentiometer 17 is outputting a decreased potential indicating movement of the shift actuator 16 toward its reverse condition, the program moves to the step S23 so as to initiate reverse rotation of the motor 24.

After the reverse rotation is initiated at the step S23, the program moves back to the step S14 to again set the shift timer and the step S15 to determine if the switches 29, 31 and 32 are all off. If they are all off, then the program again moves to the step S16 so as to set the shift action memory on and to the step S17 to again determine if any of the switches 29, 31 and 32 are on. If they are not on, the program then moves to the step S20 to determine if the timer setting has been exceeded. This will indicate if the shift to reverse has not taken place within the desired time period and if it has not then the program moves to the step S21 to initiate emergency control.

In connection with the normal control routine and after the motor 24 has been turned off at the step S19, the program moves through a control routine to verify that another shifting operation has not been initiated. This control routine consists of a first step S24 wherein it is determined if the forward switch 29 has been closed. If it has been, the program moves to the step S25 to verify that the shift actuator 16 is in its forward drive position. If it is, the program repeats. If, however, at the step S25 it is determined that the control lever is no longer in the forward drive range, then the program moves to the step S1 to set the reset control since obviously another shift is now being called for.

If it is determined at the step S24 that the forward switch 29 is not on, then the program moves to the step S26 to determine if the neutral switch is on. If it is, it is assumed that the transmission was shifted into neutral and the program then repeats. If, however, the neutral switch is not determined to be on at the step S26, the program moves to the step S27 to determine if the reverse switch 32 is on. If it is on, the program moves to the step S28 to verify that the shift actuator 16 is still in the reverse condition and if it is the program repeats.

If at the step S27 it is determined that the reverse switch is not on after it has been determined that the forward and neutral switches are not on or if at the step S28 it is determined that the shift actuator 16 is no longer in the reverse condition, then the program moves to the reset control step S1 because it is determined that another shift is being called for.

Figure 5:
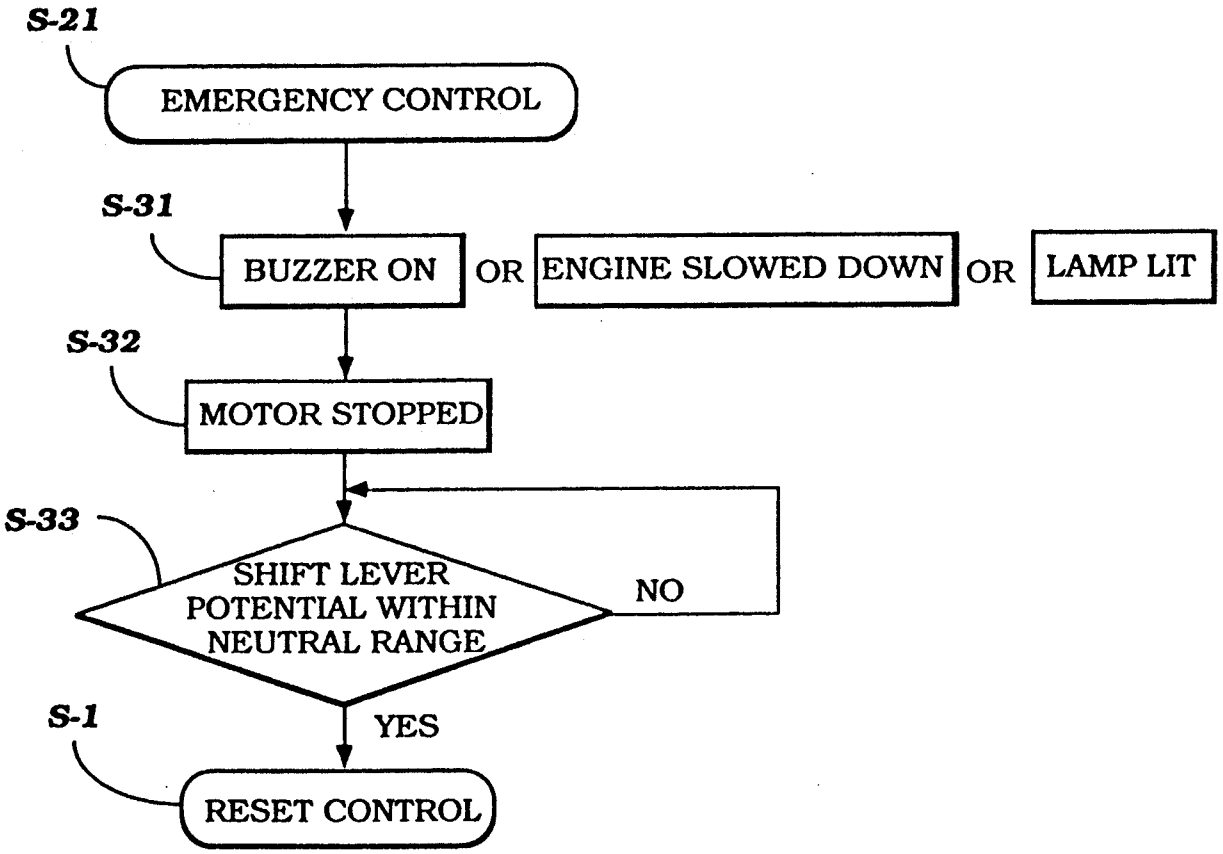
FIG. 5 is a block diagram showing the warning and reset control conditions.

The emergency control will now be described by reference to FIG. 5. If in any of the aforenoted sequences it has been determined that emergency control is required because of the fact that a shift has not been accommodated within a predetermined time period, the program moves to a step S31 so as to initiate a warning action or protection action. This may be either or all of turning a warning buzzer on and/or slowing the engine speed, and/or illuminating a warning light. The program then moves to the step S32 to stop any operation of the shift actuating motor 24. The program then moves to the step S33 so as to determine if the shift lever has been returned to the neutral condition. If it has not, the program continues to repeat. If, however, the operator has returned the shift lever to the neutral position then the program can again be initiated and the program moves to the step S1 to again initiate reset operation.

It should be readily apparent from the foregoing description that the described remote shifting system is particularly adapted in affecting remote shift control electronically without necessitating the use of a potentiometer for the shift means. Rather, only individual switches determining when the shift means is in the forward, neutral or reverse conditions need be employed. This is accomplished through the aforedescribed control routine wherein the shift mechanism is operated in a predetermined sequence to bring the transmission first to its neutral condition and then to the shift condition called for assuming that this shift condition is other than the neutral condition. Of course, the described control routine is only one and a preferred embodiment and various modifications and changes may be made without departing from the spirit and scope of the invention, as defined by the appended claims.

I claim:

1. A remote transmission control for a transmission having at least a neutral condition when drive is not transmitted and a drive condition wherein drive is transmitted shift means connected to said transmission and moveable between at least a neutral position corresponding to the neutral condition of the transmission and a drive position corresponding to the drive condition of the transmission, first position sensing means operable only between a first state when said shift means is in said neutral position and a second state when said shift means is not in said neutral position for indicating only when said shift means is in said neutral position, second position sensing means having a first state when said shift means is in said drive position and a second state when said shift means in not in said drive position for indicating only when said shift means is in said drive position, power means for moving said shift means between said positions, an operator actuated shift actuator moveable between a neutral position through a plurality of intermediate positions and a drive position, a third position sensing means for sensing the actual position of said shift actuator, and control means responsive to the operation of said shift actuator to one of its neutral and drive positions for operating said power means to position said shift means in a neutral position if said first position sensing means indicates said shift means is not in that position and then in the drive position if said shift actuator is in that position.

2. A remote transmission control according to claim 1 further including means for determining the time which has elapsed between the actuation of the shift actuator and the time in which the shift has occurred and for initiating protection action in the event the shift has not occurred within a predetermined time period.

3. A remote transmission control according to claim 2 further including means for resetting the control means when the shift has occurred within the predetermined time period.

4. A remote transmission control according to claim 3 wherein the drive condition is a forward drive condition and further including a reverse condition for the transmission, the shift means being moveable to a reverse position in addition to the neutral and drive positions, a fourth position sensing means operable only between a first state when said shift means is in said reverse position and a second state when said shift means is not in said reverse position for sensing when said shift means is in the reverse position and wherein the control means operate the power means to position said shift means in said reverse position if said shift actuator is in a reverse position after said shift means has been positioned in said neutral position.

5. A remote transmission control according to claim 4 wherein the protective action is initiated in the event the shift to any position takes more than the predetermined time period.

6. A remote transmission control according to claim 5 wherein the control means operates the power means to move the shift means toward its forward position upon initiation of operation.

7. A remote transmission control according to claim 6 wherein the control means returns the transmission to the neutral condition if the shift means was between the neutral position and its forward position when shifting operation was initiated.

8. A remote transmission control according to claim 1 wherein the drive condition is a forward drive condition and further including a reverse condition for the transmission, the shift means being moveable to a reverse position in addition to the neutral and drive positions, a fourth position sensing means operable only between a first state when said shift means is in said reverse position and a second state when said shift means is not in said reverse position for sensing when said shift means is in the reverse position and wherein the control means operate the power means to position said shift means in said reverse position if said shift actuator is in a reverse position after said shift means has been positioned in said neutral position.

9. A method of operating a remote transmission control for a transmission having at least a neutral condition when drive is not transmitted and a drive condition wherein drive is transmitted, shift means connected to said transmission and moveable between at least a neutral position corresponding to the neutral condition of the transmission and a drive position corresponding to the drive condition of the transmission, first position sensing means operable only between a first state when said shift means is in said neutral position and a second state when said shift means is not in said neutral position for indicating only when said shift means in is said neutral position; second position sensing means having a first state when said shift means is in said drive position and a second state when said shift means in not in said drive position for indicating only when said shift means is in said drive position power means for moving said shift means between position, an operator actuated shift actuator moveable between a neutral position through a plurality of intermediate positions and a drive position, a third position sensing means for sensing the actual position of said shift actuator, said method comprising sensing the operation of the shift actuator to one of its neutral and drive positions for operating the power means to position the shift means in a neutral position if said first position sensing means indicates said shift means is not in that position and then in the drive position if the shift actuator is in that position.

10. A method according to claim 9 further including determining the time which has elapsed between the actuation of the shift actuator and the time in which the shift has occurred and initiating protective action in the event the shift has not occurred within a predetermined time period.

11. A method according to claim 10 further including restarting the method when the shift has occurred within the predetermined time period.

12. A method according to claim 11 wherein the drive condition is a forward drive condition and further including a reverse condition for the transmission, the shift means being moveable to a reverse position in addition to the neutral and drive positions, a fourth position sensing means operable only between a first state when said shift means is in said reverse position and a second state when said shift means is not in said reverse position for sensing when said shift means is in the reverse position and wherein shift the means is positioned in said reverse position if said shift actuator is in a reverse position after said shift means has been positioned in said neutral position.

13. A method according to claim 12 wherein protective action is initiated in the event the shift to any position takes more than the predetermined time period.

14. A method according to claim 13 wherein the shift means is moved toward its forward position upon initiation of operation.

15. A method according to claim 14 wherein the transmission is returned to the neutral condition if the shift means was between the neutral position and its forward position when shifting operation was initiated.

16. A method according to claim 9 wherein the drive condition is a forward drive condition and further including a reverse condition for the transmission, the shift means being moveable to a reverse position in addition to the neutral and drive positions, a fourth position sensing means for sensing when the shift means is in the reverse position and wherein the shift means is positioned in said reverse position if said shift actuator is in a reverse position after said shift means has been positioned in said neutral position.

* * * * *